US009199160B2

(12) United States Patent
Bazarko

(10) Patent No.: US 9,199,160 B2
(45) Date of Patent: Dec. 1, 2015

(54) TOY GAME APPARATUS AND METHOD OF PLAYING

(71) Applicant: Jeffrey W. Bazarko, El Segundo, CA (US)

(72) Inventor: Jeffrey W. Bazarko, El Segundo, CA (US)

(73) Assignee: MATTEL, INC., El Segundo, CA (US)

( * ) Notice: Subject to any disclaimer, the term of this patent is extended or adjusted under 35 U.S.C. 154(b) by 21 days.

(21) Appl. No.: 13/782,082

(22) Filed: Mar. 1, 2013

(65) Prior Publication Data

US 2014/0077456 A1 Mar. 20, 2014

Related U.S. Application Data

(60) Provisional application No. 61/605,526, filed on Mar. 1, 2012.

(51) Int. Cl.
*A63F 3/00* (2006.01)
*A63F 9/28* (2006.01)
*A63F 9/30* (2006.01)

(52) U.S. Cl.
CPC ..... *A63F 3/00261* (2013.01); *A63F 9/28* (2013.01); *A63F 9/30* (2013.01)

(58) Field of Classification Search
CPC ..... A63H 3/00261; A63F 9/30; A63F 9/28
USPC ..... 273/241, 280, 281, 287
See application file for complete search history.

(56) References Cited

U.S. PATENT DOCUMENTS 276,539 A 4/1883 Reed
284,965 A 9/1883 Ireland
621,659 A 3/1899 Halder
726,397 A 4/1903 Brinkmann
957,472 A 5/1910 Mitchell
671,626 A 10/1910 Nelson
997,314 A 7/1911 Moore
1,212,698 A 1/1917 Ziehler et al.
1,223,859 A 4/1917 Doan
1,235,771 A 8/1917 Dettra
1,571,503 A 2/1926 Barber
2,001,918 A * 5/1935 Nevius ..... 273/309
2,427,434 A 9/1947 Whitehouse
2,442,526 A 6/1948 Wright
2,516,997 A * 8/1950 Kellinger et al. ..... 273/127 D
3,110,499 A * 11/1963 Boeskool ..... 273/139
(Continued)

FOREIGN PATENT DOCUMENTS

GB 2028148 A 3/1980

*Primary Examiner* — Vishu Mendiratta
(74) *Attorney, Agent, or Firm* — Cantor Colburn LLP

(57) ABSTRACT

A toy is provided, the toy having: a plurality of playing pieces; an object configured to be slid along a surface; and a structure having a first end and a second end, the structure further comprises: a bridge that defines a path from the first end of the structure to the second end of the structure, wherein the path is elevated from the surface and is defined by an upper surface of a plurality of members, wherein each of the plurality of members are pivotally mounted to the structure for movement between a first position and a second position, a portion of the plurality of members having a lower portion extending from the upper surface, the lower portion terminating at a distal end that is supported above the surface, wherein the upper surface of each of the plurality of members is configured to support at least one of the plurality of playing pieces thereon without contacting an adjacent one of the plurality of members.

16 Claims, 5 Drawing Sheets

(56) References Cited

U.S. PATENT DOCUMENTS

| | | | | | |
|---|---|---|---|---|---|
| 3,635,476 | A | | 1/1972 | Breslow et al. | |
| 3,649,018 | A | | 3/1972 | Beam | |
| 3,690,664 | A | | 9/1972 | Hauke | |
| 3,791,653 | A | * | 2/1974 | Yamada | 473/186 |
| 3,897,952 | A | | 8/1975 | Breslow | |
| 3,899,170 | A | | 8/1975 | Parks et al. | |
| 4,125,262 | A | | 11/1978 | Erickson | |
| 4,146,227 | A | | 3/1979 | Kuna | |
| 4,147,358 | A | | 4/1979 | Erickson | |
| 4,157,183 | A | | 6/1979 | Meyer et al. | |
| 4,192,512 | A | | 3/1980 | Erickson et al. | |
| 4,206,925 | A | | 6/1980 | Goldfarb et al. | |
| 4,333,655 | A | | 6/1982 | Rudell et al. | |
| 4,348,028 | A | | 9/1982 | Barlow | |
| 4,661,080 | A | | 4/1987 | Goldstein et al. | |
| 4,679,793 | A | | 7/1987 | Gonzalez | |
| 4,696,477 | A | | 9/1987 | Tsuzuki | |
| 4,852,886 | A | | 8/1989 | Zaruba et al. | |
| 4,938,481 | A | | 7/1990 | Goldfarb et al. | |
| 4,979,926 | A | | 12/1990 | Bisceglia | |
| 5,129,655 | A | | 7/1992 | Gillespie et al. | |
| 5,135,221 | A | | 8/1992 | Barlow | |
| 5,413,533 | A | * | 5/1995 | Bolus et al. | 473/55 |
| 5,531,447 | A | | 7/1996 | Nagasaka et al. | |
| 5,540,439 | A | | 7/1996 | Kamentsky | |
| 6,155,571 | A | | 12/2000 | Reinertsen | |
| 6,669,197 | B1 | | 12/2003 | Lund et al. | |
| 7,306,227 | B2 | | 12/2007 | Kenney | |
| 7,819,404 | B2 | | 10/2010 | Creech et al. | |
| 7,837,197 | B2 | | 11/2010 | Kishon et al. | |

* cited by examiner

TOY GAME APPARATUS AND METHOD OF PLAYING

CROSS REFERENCE TO RELATED APPLICATIONS

This application claims the benefit of U.S. Provisional Patent Application Ser. No. 61/605,526 filed Mar. 1, 2012, the contents of which are incorporated herein by reference thereto.

BACKGROUND

Various embodiments of the present invention relate to a toy game and more particularly, a toy game that provides an element of excitement to the game. Board games, in particular, provide such entertainment. However, if the board game does not provide an added level of uncertainty, anticipation, or surprise the game itself may become mundane with repeated use. Accordingly, it is desirable to provide a game that provides an added level of uncertainty and interaction between the players as well as requiring some skill.

SUMMARY OF THE INVENTION

In one embodiment a toy is provided, the toy having: a plurality of playing pieces; an object configured to be slid along a surface; and a structure having a first end and a second end, the structure further comprises: a bridge that defines a path from the first end of the structure to the second end of the structure, wherein the path is elevated from the surface and is defined by an upper surface of a plurality of members, wherein each of the plurality of members are pivotally mounted to the structure for movement between a first position and a second position, a portion of the plurality of members having a lower portion extending from the upper surface, the lower portion terminating at a distal end that is supported above the surface, wherein the upper surface of each of the plurality of members is configured to support at least one of the plurality of playing pieces thereon without contacting an adjacent one of the plurality of members.

In another embodiment a method of playing a game is provided, the method comprising the steps of: providing a structure having a bridge that defines a path from a first end of the structure to a second end of the structure, wherein the path is defined by a plurality of members pivotally mounted to the structure wherein each of the plurality of members have an upper surface defining one of a plurality of spaces and a lower portion extending from the upper surface, the lower portion terminating at a distal end that is supported above a surface on which the structure is supported providing a first player of the game with a predetermined amount of first game pieces at the first end of the structure; providing a second player of the game with a predetermined amount of second game pieces at a second end of the structure, the second game pieces being different from the first game pieces; moving one of a plurality of members from a first position to a second position; moving at least one of the first player's game pieces a predetermined amount of spaces along the path from the first end towards the second end based upon the moved one of the plurality of members; moving another one of the plurality of members from a first position to a second position; moving at least one of the second player's game pieces a predetermined amount of spaces along the path from the second end towards the first end based upon the moved another one of the plurality of members; and determining a winner of the game when a winning amount of first player's game pieces are moved along the path from the first end to the second end or when a winning amount of the predetermined amount of second player's game pieces are moved along the path from the second end to the first end.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1:
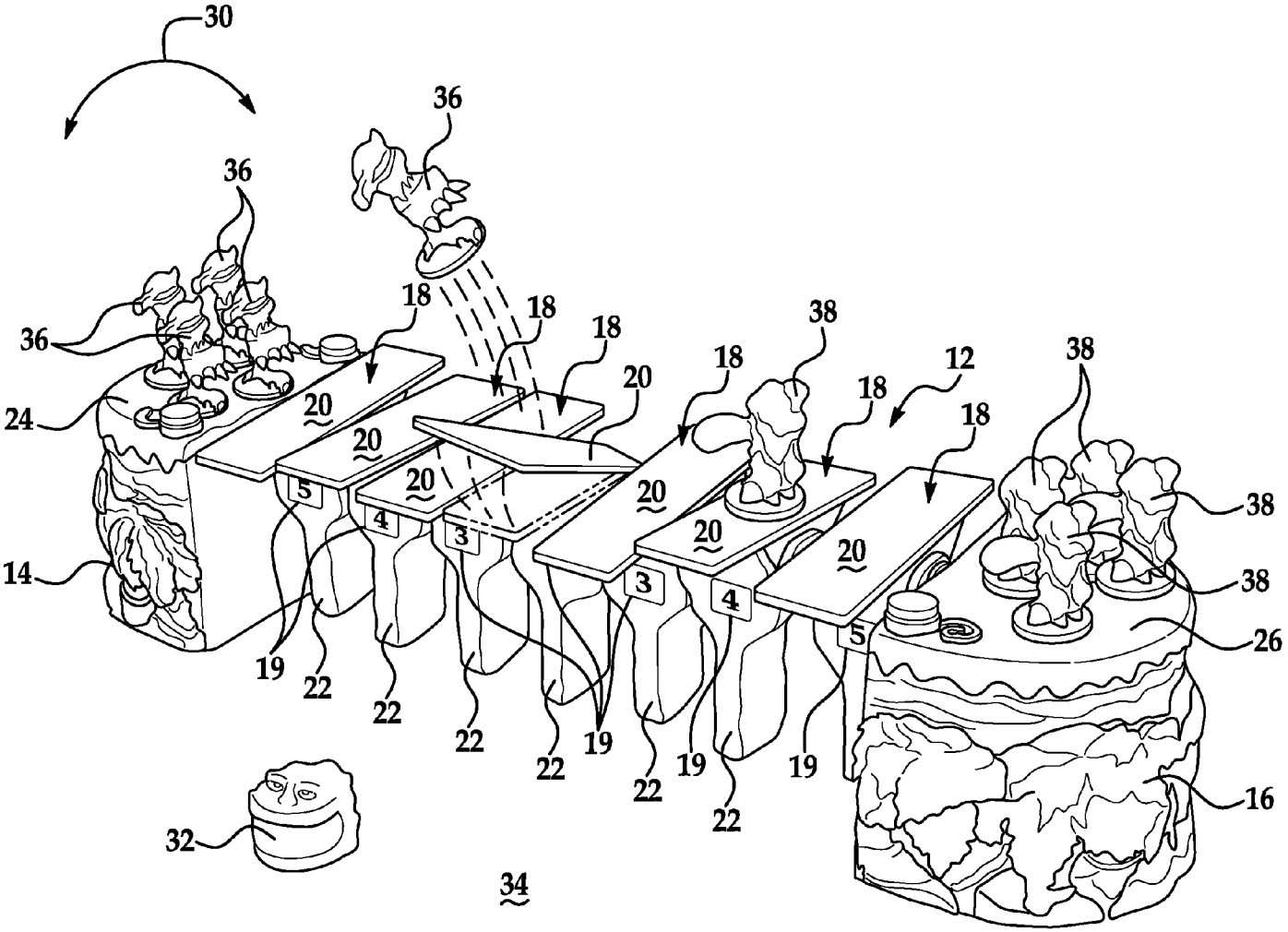
FIG. 1 is a perspective view of a game in accordance with one embodiment.
Figure 1A:
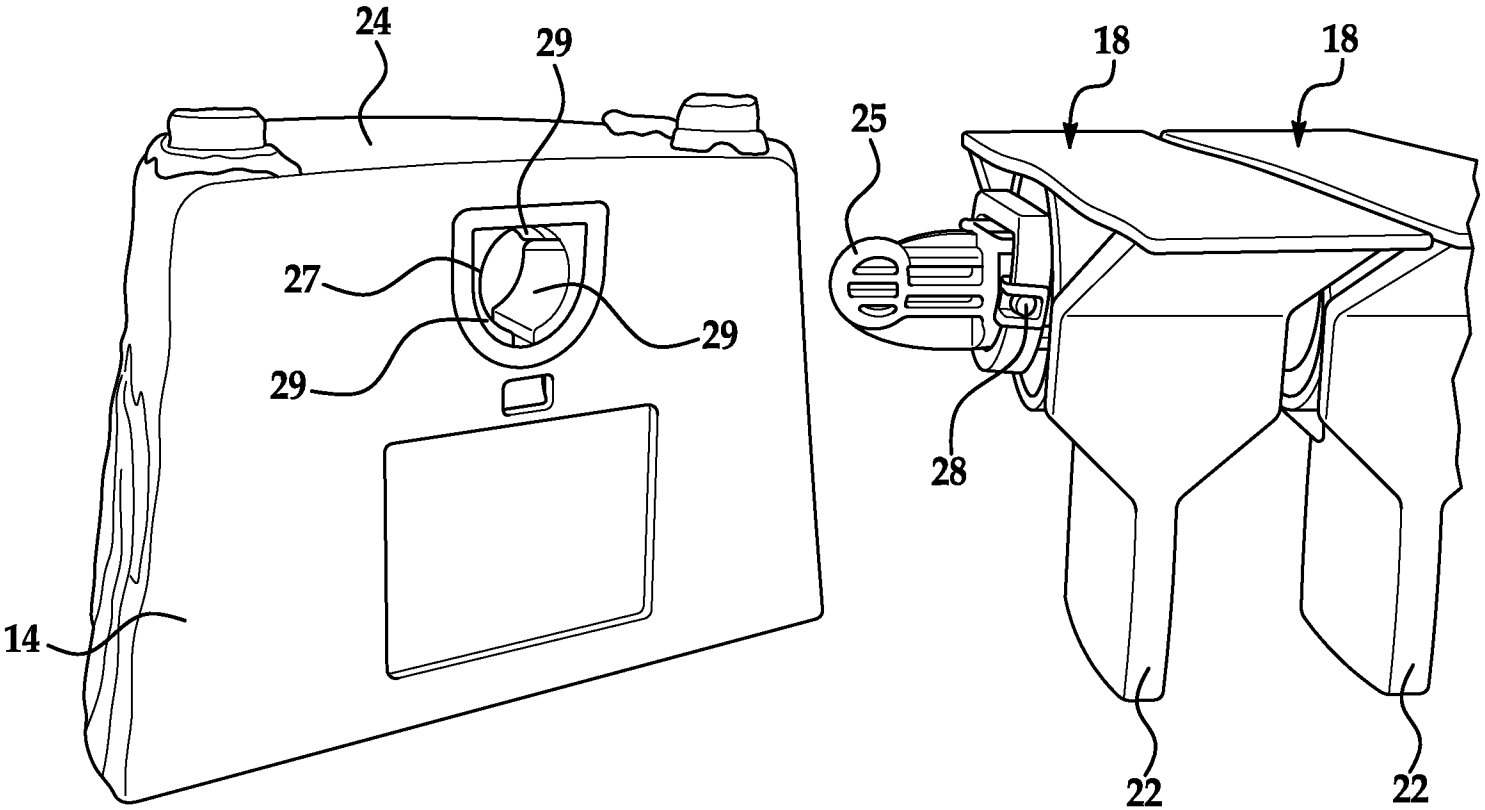
FIG. 1A is view illustrating components of the game in accordance with one non-limiting embodiment.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Referring now to the FIGS., a game 10 and a method of playing a game is provided. As illustrated in the attached FIGS., the game includes a structure 12 having a first end 14 and an opposing second end 16 each being separated by a plurality of members 18 movably secured to the structure 12. In one exemplary embodiment, first end 14 and opposing second end 16 are "snap fittingly" or removably secured to a rod or equivalent member 28 that rotatably supports members 18. In one non-limiting exemplary embodiment, each distal end of rod 28 has a curved surface or ball member 25 that is removably secured to a socket 27 via a plurality of tab members or arms 29 in socket 27. Accordingly curved surface or member 25 can be removably secured to socket 27 in order to provide a means for assembling and disassembling structure 12 for use in gameplay (e.g., assembled structure having a first end 14 and opposing second end 16 secured to rod 28 and disassembled structure having first end 14 and opposing second end 16 removed from rod 28 for storage). Of course, numerous other equivalent structures for releasably securing end 14 and 16 to rod 28 are considered to be within the scope of exemplary embodiments of the present invention.

Each of the plurality of members 18 have an upper surface 20 and a lower portion 22 extending from the upper surface 20. The upper surface 20 of each of the plurality of members 18 provides a space of a path that extends from the first end 14 to the second end 16.

Each member 18 is capable of being located in a first position wherein the upper surface 20 is in a generally horizontal configuration such that it lies in the same plane or parallel plane as an upper surface 24 of first end 14 and an upper surface 26 of second end 16 and a second position wherein the upper surface 20 is no longer in the generally horizontal configuration. It is, of course, understood that surfaces 20 can have various positions with respect to the surfaces 24 and 26 as long as surfaces 20 provide a supporting surface for one of the game pieces when they are in the first position.

Each of the plurality of members 18 is pivotally or rotationally mounted to the structure 12 via a rod or other equivalent member 28 that extends from first end 14 to second end 16. Accordingly, each of the plurality of members 18 is capable of rotation, movement or pivotal movement in the direction of arrows 30.

The game further comprises an object or puck 32 that is configured to slide along a surface 34 upon which the game 10 is supported. In one embodiment, the object or puck 32 is configured to have a ball bearing rotationally received therein such that the ball bearing makes contact with surface 34 and facilitates the sliding movement of object or puck along surface 34.

Each of the plurality of members 18 is configured such that a distal end 23 of the lower portion 22 is positioned above surface 34 when the member 18 is in the first position. However, each lower portion 22 and its associated distal end 23 is configured to be close enough to surface 34 such that should the puck or object 32 be slid into the structure it may contact one of the lower portions 22 and cause the contacted member 18 to rotate in one of the directions of arrows 30. Still further, each member 18 is configured such that should it be contacted by puck or object 32 it will rotate from the first position and relocate into a second position wherein upper surface 20 is no longer in the same plane or parallel plane as surfaces 24 and 26. In other words, surface 20 is moved from a game piece supporting configuration (first position) to a non-game piece supporting configuration (second position). In some embodiments, when a member 18 is relocated into the second position, this second position provides an indication of how many spaces a player may move their game pieces after sliding puck or object 32 towards the structure 12. As such, movement of one of the plurality of members is similar to rolling a die in that it provides a numerical value for one of the players to use in conjunction with moving their game pieces along the path defined by the plurality of members 18.

Game 10 further comprises a first plurality of game pieces 36 and a second plurality of game pieces 38. Game pieces 36 and 38 are configured to be placed and sized to fit upon the upper surface 20 of a member 18 when member 18 is in the first position. In one embodiment, each of the game pieces 36 are configured to have a first similar shape and configuration and each of the game pieces 38 are configured to have a second similar shape and configuration wherein the first shape is different than the second shape such that players of the game will be able to differentiate between each other's game pieces. Still further, each of the game pieces 36, 38 and surfaces 20 are configured such that placement of one of the game pieces on one of the surfaces 20 will not cause the game piece to come into contact with an adjacent surface 20.

In one embodiment, the game will be configured to have a theme such that structure 12 will resemble a bridge and game pieces 36 and 38 will resemble jungle creatures and object or puck 32 will resemble another creature, which may be a predator of the creatures resembled by game pieces 36 and 38. Of course, numerous other configurations are considered to be within the scope of exemplary embodiments of the present invention. In addition, each of the plurality of members 18 is marked with indicia 19 or a number which will be discussed below.

As mentioned above and in one embodiment, the structure 12 of the game 10 is configured to resemble a bridge and during gameplay each player attempts to have their game pieces traverse the bridge from one and to the other end by moving across the plurality of members 18 wherein each of the members 18 represents a space that the game pieces must travel across. In addition and during gameplay, each player will have an opportunity to slide object 32 along surface 34 in an attempt to move a member 18 from its first position to the second position, which will cause one of the plurality of game pieces 36, 38 to be launched therefrom if they are resting upon surface 20 of member 18 when it is contacted by object 32.

In one embodiment gameplay is as follows although numerous variations as described herein or combinations thereof are considered to be within the scope of exemplary embodiments of the present invention. In one non-limiting exemplary embodiment, each player is provided with a predetermined amount of game pieces and the other player is also provided with a predetermined amount of different game pieces. Each player then positions their game pieces on one of the respective surfaces 24, 26 such that all of one player's game pieces are on one side of the structure 12 and all of the other players game pieces are on the opposite side of the structure 12 and the winner of the game is determined by the first player to get a predetermined amount of game pieces from one end of the structure to the other end of the structure. In one non-limiting embodiment, the first player to get three of their game pieces across the bridge to the other side wins the game. Of course, other numbers greater or less than three can be used to determine the winner of the game. For example and in one alternative, the first player to get a portion of their game pieces (e.g., two of three of their game pieces) onto the other side wins the game. Of course, numerous other combinations are considered to be within the scope of various embodiments of the present invention.

In various embodiments the rules of the game may vary for example and in one embodiment, there is no need to have the exact number for a player to move their game piece to the opposite end (e.g., a game piece two spaces from the end does not need the exact number two to reach the end). Alternatively, the game can be played wherein the corresponding exact number of spaces is required to move the game piece to the end.

Figure 3:
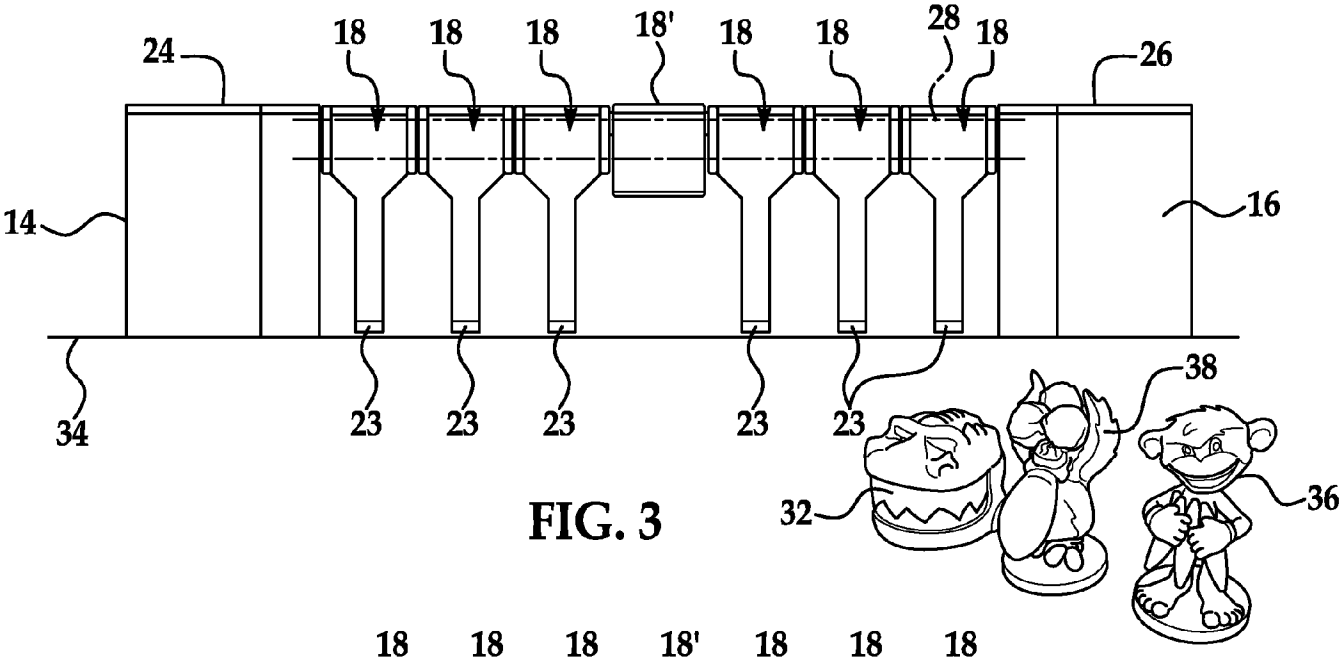
FIG. 3 is another view of the game in accordance with an embodiment.
Figure 4:
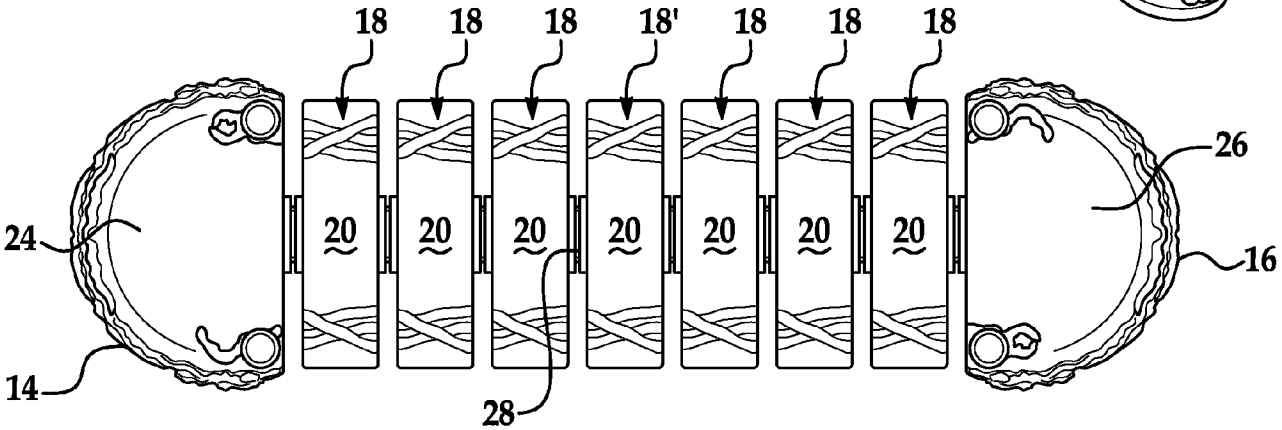
FIG. 4 is a top view of a structure for use in the game according to one embodiment.

In one exemplary embodiment and as illustrated in at least FIGS. 3 and 4, the structure 12 has a plurality of members 18 located on either side of a centrally located member 18'. In this embodiment each of the plurality of members 18 has a lower portion 22 while centrally located member 18' does not have a corresponding lower portion 22 or a lower portion of the centrally located member 18' is configured to define a gap between the centrally located member 18' and the surface 34 the structure 12 is resting on, wherein the gap is greater than a height of the object 32. Since the center plank or member 18' in this embodiment does not have an associated lower portion 22 or is configured to define a gap greater than the height of the object, this plank or member 18' cannot be rotated by puck or object 32 and thus plank or member 18' does not rotate and is considered a "safe zone" upon which a player's piece may rest. Alternatively, central member 18' can be fixedly secured to the structure 12 such that it is incapable of movement from a corresponding first position.

As mentioned above, each lower portion 22 terminates at a distal end 23 that is supported above surface 34 upon which ends 14 and 16 are placed. Accordingly, movement of the plurality of members 18 from a first position (illustrated in at least FIGS. 3 and 4) to a second position wherein surface 20 is no longer in a supporting configuration for a game piece is possible since lower portion 22 will not contact surface 34. Therefore, any game piece located upon surface 20 prior to its being moved from the first position to the second position will be dislodged therefrom.

As shown in this embodiment, each lower portion 22 has a similar configuration and provides a target that is capable of being contacted by object 32 as it is slid along surface 34. As will be described below, movement of the members 18 by contacting portions 22 with object 32 allows players to receive a numerical value for moving their game pieces along the path as well as providing a means for dislodging or knocking and opposing players game pieces from the path by moving the surface 20 upon which the game piece is resting.

In order to move their game pieces, each player takes turns sliding the object or puck 32 towards or under the bridge or structure 12, which will cause it to spin one or more of the planks or members 18 of the bridge by contacting portion 22 of member 18. In some embodiments, each plank or member 18 of the bridge or structure 12 has a number printed on it and this number indicates how many spaces a player may move their game pieces in order to cross the bridge. For example, if the puck or object 32 hits a bridge plank or member 18 and rotates it, then the player gets to move their pieces as many spaces as the number that is shown on the bridge piece or member 18 that they hit.

If the puck or object 32 slides under or around the bridge or structure 12 without hitting any bridge plank or member 18, then the player does not get to move any pieces this round. As mentioned above, the center plank or member 18' does not have an associated lower portion 22 and thus this plank or member 18' cannot be rotated by puck or object 32. Accordingly, this plank or member 18' does not rotate and is considered a "safe zone" upon which a player's piece may rest.

In one embodiment and in the event two planks or members 18 are moved upwardly through contact with object or puck 32, the one with the lowest number on it is used in the game. In yet another alternative embodiment, the number associated with the moved member 18 may also indicate the number of game pieces that can be moved. For example, if the number "3" is obtained, three game pieces may be or must be moved using the number "3" in any one of the variations described herein.

In the embodiment illustrated in FIGS. 3-4, there are six members 18 with three located on each side of the central member 18'. In one embodiment, the numerical values associated with the members 18 is as follows: 1, 2, 3, 0, 3, 2, 1, wherein the members 18 closest to the ends 14 and 16 have the lowest value (e.g., 1) and the members 18 closest to the centrally located member or safe zone 18' have the highest value (e.g., 3). Of course, numerous other number combinations and variations thereof are contemplated to be within the scope of exemplary embodiments of the present invention and the aforementioned values represent one non-limiting embodiment.

Figure 2:
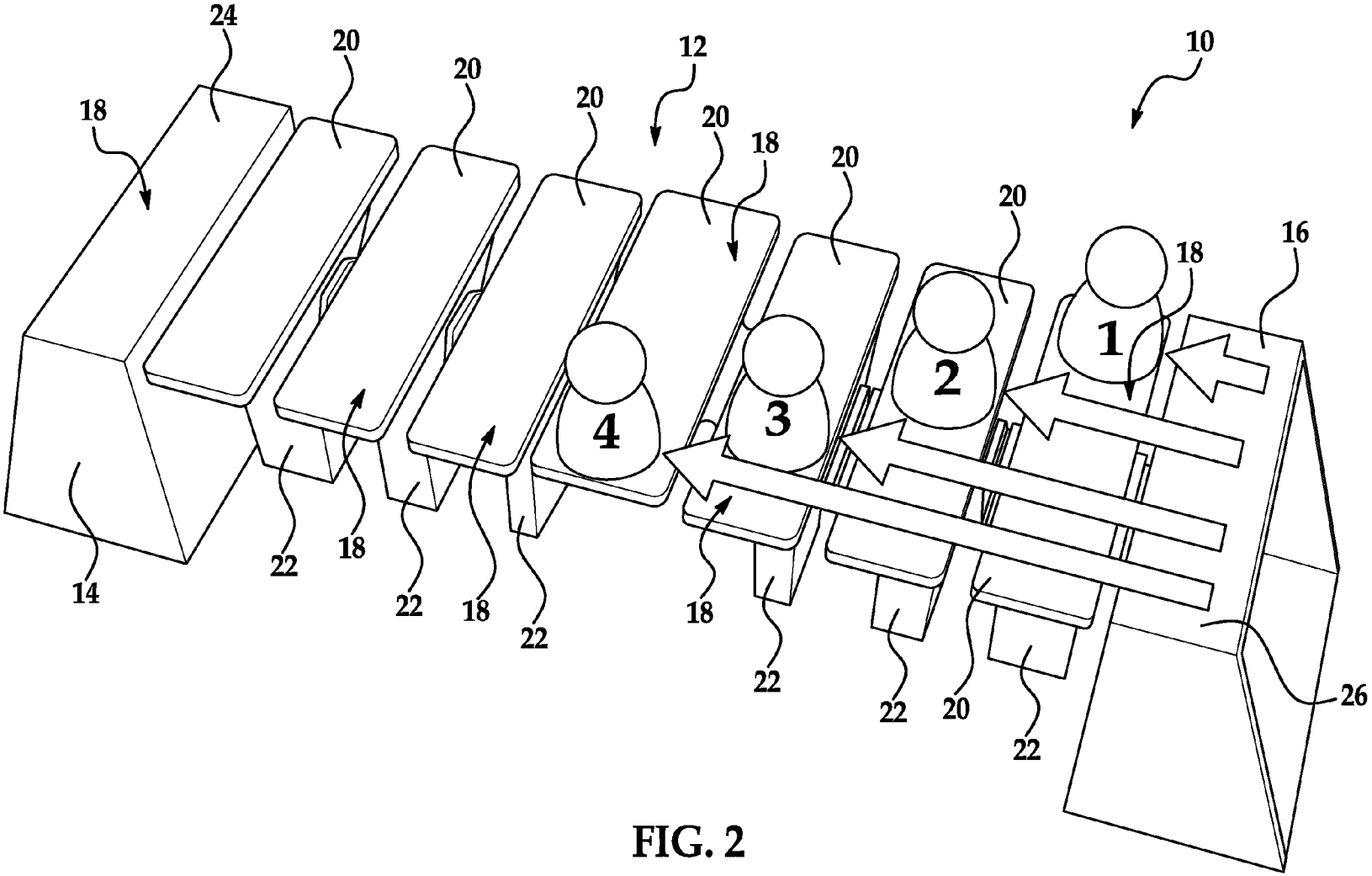
FIG. 2 is a perspective view of a game in accordance with an alternative embodiment.

Still further and referring to at least FIG. 2 and in one alternative embodiment, the lower portions 22 of each of the plurality of members 18 have widths of various thicknesses thus providing varying targets or surface areas capable of being hit by object 32. For example and as illustrated in FIG. 2, the members 18 closest to ends 16 and 14 have the largest width thus they are the easiest targets to hit. Accordingly, the associated point value with each of these targets is less than those further away from the respective ends since the portions 22 of the members 18 closer to the center of the structure have a smaller width and thus provide a smaller target for object 32 to hit. In addition and in an alternative embodiment, the centrally located member 18' can be configured to have a lower portion 22 such that the centrally located member 18' can also be relocated from the first position to the second position by movement of object 32 into the structure 12. See for example the configuration in at least FIG. 1. Alternatively, each of the lower portions 22 may have the same thickness.

In addition and in any of the aforementioned embodiments, it may be more desirable to knock an opposing player's game piece off of the structure after they have moved it a significant amount of spaces from their respective end of the structure.

As mentioned above, numerous other configurations are considered to be within the scope of exemplary embodiments of the present invention for example, and as illustrated in FIG. 2, there are eight members 18 with point values as follows: 2, 4, 6, 4, 6, 4, 2 thus the maximum amount of spaces a player may obtain a one turn with this embodiment is "6" if, of course, they are able to hit one of the members 18 that are three spaces away from a respective end. Also, shown here is that these members 18 with the highest point values have the smallest width for their associated lower portion 22. In yet another embodiment, the point values may differ from the above-mentioned values.

If during their turn, a player slides the object 32 into one of the planks or members 18 and rotates the same, that player is now allowed to move a game piece a predetermined amount of spaces across the bridge based upon the number located on the plank or member 18 hit by the puck or object 32. For example, if the player hits one of the members 18 that has the number four on it that player is now allowed to move one of their game pieces four spaces or planks from one end of the bridge to the other. Alternatively, that player can break the movement up into any various combinations that add up to the number four. For example, this player can move one piece three spaces and another piece one space. In some embodiments of the game, a player may not break up the number of moves if two game pieces would rest on the same member or plank 18. Instead, the player must use a number of moves that causes the game piece to be located on the next empty space. In yet another alternative, a player may or must move all of their game pieces according to the number identified on the plank or member 18 hit by the puck or object 32. In this example and if the player has three game pieces all of which have not been moved from their corresponding end and the number provided by the moved plank or member 18 is "1" each piece is or must be moved one space. However and since one piece will occupy an open plank right next to the end the next two pieces must be placed on the next available open plank. Accordingly and in this example, the first three empty spots next to the end will now be occupied by the three game pieces of that player. Of course, numerous other iterations and combinations are considered to be within the scope of various embodiments of the present invention.

FIG. 2 also illustrates movement of game pieces along the surfaces 20 of the members 18 of the structure 12 in accordance with one exemplary embodiment. FIG. 2 illustrates game pieces that have been moved 1, 2, 3 and 4 spaces respectively. In one exemplary embodiment, movement of the player's piece from one of the ends 14, 16 to an adjacent surface or space 20 constitutes movement of one space and since this one space is now occupied, the next move of the same player's next game piece constitutes movement of one space to the next unoccupied space or surface 20. Accordingly, a player of the game during their turn can move multiple pieces to multiple locations on the path. In accordance with one set of game rules only one game piece of each player may occupy a plank or member 18. Thus movement of a player's game pieces must be to an unoccupied space. However, in some embodiments, game pieces of opposing players may share a plank. Alternatively and in yet other embodiments, multiple game pieces of a single player may be allowed to share a plank, or no game pieces may share a plank regardless of whose player the pieces represent.

For example and referring to the illustrated positions of the game pieces in FIG. 2, a first game piece identified as "1" is moved to the first space adjacent to end 16 and thus constitutes a single movement. Thereafter, a second game piece identified as "2" is moved to the first free space adjacent to game piece "1" and thus constitutes a single movement. Thereafter, a third game piece identified as "3" is moved to the first free space adjacent to game piece "2" and thus constitutes a single movement. Finally, a fourth game piece identified as "4" is moved to the first free space adjacent to game piece "3" and thus constitutes a single movement. Accordingly, movement of the four game pieces into the positions illustrated in FIG. 2 may be achieved by obtaining a number "4" from moving one of the plurality of members 18 that has an associated numerical value of "4" into the second position. Alternatively and as mentioned above, this movement can also be achieved in the embodiment where all of the game pieces must be moved and the number "1" was obtained and the player has four game pieces and each of the four planks next to the end 16 were open or unoccupied.

Alternatively, a player could move a single game piece four spaces to the center position illustrated in FIG. 2 with the same number "4" however, this would only position one game piece on the path towards the other end as opposed to the illustrated configuration wherein four game pieces are now on the path towards the other end.

In yet another variation and wherein the rules do not allow a player to have multiple game pieces on the same plank, the moves may be split up through a combination of multiple separate moves of one game piece and a single movement of another game piece. For example, if the number 3 is obtained by moving one of the members 18, a first game piece A may be moved one space and a second game piece B may be moved one space and the first game piece A may now be moved one space again, provided that pieces A and B cannot occupy the same plank or member 18. By using this variation it may be possible to move game pieces A and B more than three spaces since the prior movement may cause the next available space to be occupied. This embodiment will add a factor of strategy and gamesmanship to the game for advanced gameplay.

As the game progresses, game pieces become located on some of the surfaces 20 of the planks or members 18 and therefore when a player takes their turn and slides the puck or object 32 into one of the planks or members 18 it is now possible for them to hit a plank or member 18 that has a game piece on it. When this occurs, the game piece will be tossed from the bridge or structure 12. (See at least FIG. 1) In accordance with the rules of one non-limiting embodiment of the game, any dislodged game piece (even if they were not on the piece that was on the member 18 that was hit) must go back to its starting position (e.g., one of the ends 14 or 16). In yet another embodiment, the rules may provide that only game pieces dislodged on the member 18 that was actually hit must be moved back to the starting position and any other game pieces inadvertently knocked off or located on other members 18 that were not directly hit by the object 32 remain on those members even if they were knocked off.

Once a plank or member 18 is hit by the object 32, it should rotate freely however and in one embodiment it will not move back to the horizontal or first position thus providing a clear indication of which member 18 which was hit by the object 32. Thus, the player will easily be able to determine the number of spaces they can move their game pieces (e.g., the dislodged member 18 will not be flush with the other members 18 and thus the user is allowed to use the number associated with therewith as the number of spaces they may now move their game pieces). Afterwards and when the players change turns, the dislodged member 18 can be returned to the first position such that it can once again be struck by puck or object 32. Alternatively, the dislodged or struck members 18 may remain in the second position during game play thus providing fewer and fewer members 18 to be struck with puck or object 32 as the game progresses. This method of game play may also provide fewer and fewer spaces for the game pieces to rest upon as they travel from one end to the other. Alternatively, plank or member 18 can be configured to return back to the first position and some other means of determining the number of spaces the player can move their game pieces can be provided.

Figure 5:
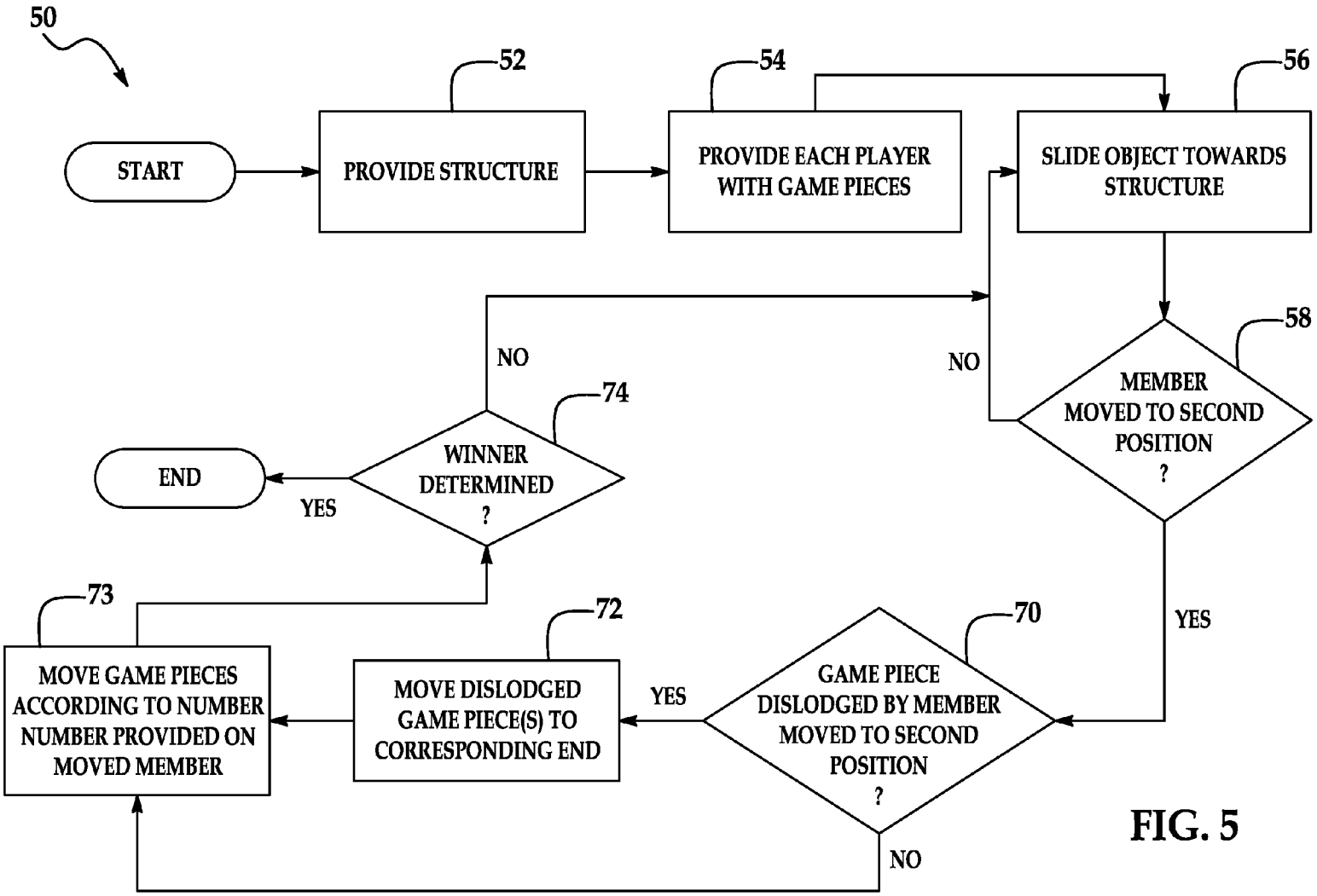
FIG. 5 is a flow chart schematically illustrating a method playing a game in accordance with one non-limiting embodiment of the present invention.

Referring now to FIG. 5, a flowchart 50 illustrating one exemplary method of playing the game 10 is provided. At a first step 52 a structure is provided. As mentioned herein, the structure has a bridge that defines a path from a first end of the structure to a second end of the structure, wherein the path is defined by a plurality of spaces. In a next step 54, a first player of the game is provided with a predetermined amount of first game pieces at the first end of the structure and a second player of the game is provided with a predetermined amount of second game pieces at a second end of the structure. In one implementation, the second game pieces are different from the first game pieces.

At a step 56, a first player slides the object 32 towards one of the plurality of members 18. At decision node 58, if the object 32 moves one of the plurality of members 18 from the first position to a second position, a numerical value is obtained by the first player. If no member moves from the first position to the second position, the player's turn ends, and the next player slides the object 32 towards the plurality of members 18. At decision node 70, if any of the game pieces are dislodged by movement of one of the plurality of members 18 from the first position to the second position the dislodged game pieces are returned to their respective end (14, 16) at step 72. Thereafter and at step 73, the first player moves one or more of their game pieces along the path by resting them upon one of the plurality of surfaces 20 according to any one of the previously provided rules or combinations thereof based on the numerical value obtained by the first player.

If no winner is determined at decision node 74 play continues to step 56 and a second player slides the object 32 towards one of the plurality of members 18. At decision node 58 and if the object 32 moves one of the plurality of members 18 from the first position to a second position, a numerical value is obtained by the second player. At step 73, the second player moves their game pieces along the path by resting them upon one of the plurality of surfaces 20 according to any one of the previously provided rules or combinations thereof based on the numerical value obtained by the second player. Also shown at decision node 70 is that if any game pieces are dislodged by movement of one of the plurality of members 18 from the first position to the second position they are returned to their respective end (14, 16) at step 72.

Steps 56, 58, 70, 72 and 73 are repeated by each player until a winner of the game is determined at decision node 74. A winner may be determined when all of a predetermined amount of first player's game pieces are moved from the first end to the second end or when all of a predetermined amount of second player's game pieces are moved from the second end to the first end. In some embodiments, a winner is determined as the player who has a predetermined number of or predetermined subset of game pieces first reach the opposing end.

Accordingly, a method and apparatus for playing a game is provided wherein players of the game try to be the first one to have their game pieces traverse a structure by moving an object towards the structure to cause movable members of the structure to move from a first position to a second position in order to provide that player with a number for use in moving their game pieces as well as providing a means for a player to dislodge or toss an opposing player's game pieces from a surface of the movable member that is hit.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A toy, comprising:

a plurality of playing pieces;

an object configured to slide along a surface; and a structure having a first end with a first surface, a second end with a second surface and a rod extending between the first end and the second end;

a plurality of members each being rotatably mounted to the rod for movement between a first position and a second position, each of the plurality of members having a lower portion located below the rod and positioned above the surface when the first end and the second end are located on the surface, wherein each of the plurality of members has an upper surface located above the rod that extends outwardly away from the rod in two opposite directions and wherein the upper surface is generally horizontal and aligned with the first surface and the second surface when its member of the plurality of members is in the first position; and a centrally located member secured to the rod and positioned between the first end and the second end and aligned with the plurality of members and wherein the centrally located member is fixedly secured to the rod, wherein a lower portion of the centrally located member extends downwardly from the rod and has a length that is less than that of the lower portion of the plurality of members such that a gap larger than the object is located between the surface and a distal end of the lower portion of the centrally located member.

2. The toy as in claim 1, wherein a playing piece of the plurality of playing pieces is located at a position elevated from the surface when it is placed upon the upper surface of one of the plurality of members when the one of the plurality of members is in the first position.

3. The toy as in claim 2, wherein the playing piece dislodges from the position and the upper surface when the one of the plurality of members moves from the first position to the second position.

4. The toy as in claim 3, wherein the one of the plurality of members moves from the first position to the second position when the object contacts the lower portion of the one of the plurality of members.

5. The toy as in claim 1, wherein at least one of the plurality of members moves from the first position to the second position when the object contacts the lower portion of the at least one of the plurality of members.

6. The toy as in claim 1, wherein the playing pieces are subdivided into a first group of playing pieces and a second group of playing pieces, wherein the first group is different from the second group.

7. The toy as in claim 1, wherein the lower portion of each of the plurality of members is configured to have similar dimensions.

8. The toy as in claim 1, wherein the lower portion of the plurality of members varies in width.

9. A toy, comprising:

a bridge traversing from a first vertical end structure to a second vertical end structure, the bridge further comprising a plurality of planks rotatably mounted to a member extending horizontally from the first vertical end structure to the second vertical end structure, wherein each of the plurality of planks have an upper portion and a lower portion extending downwardly from the upper portion, the lower portion extending to a position below the member but not past a bottom of the first vertical end structure and the second vertical end structure;

a plurality of playing pieces;

an object configured to pass between the first vertical end structure and the second vertical end structure when the object, the first vertical end structure and the second vertical end structure are located on a surface, the object having a height less than a distance from the member to the bottom of the first vertical end structure and the bottom of second vertical end structure and greater than a distance between a distal end of the lower portion and the bottom of the first vertical end structure and the bottom of second vertical end structure; and a centrally located plank secured to the member and positioned between the first vertical end structure and the second vertical end structure and aligned with the plurality of planks and wherein the centrally located plank is fixedly secured to the member, wherein a lower portion of the centrally located plank extends downwardly from the member and has a length that is less than that of the lower portion of the plurality of planks such that a gap larger than the object is located between the surface and a distal end of the lower portion of the centrally located plank.

10. The toy as in claim 9, wherein each of the plurality of planks are rotatable except the centrally located plank from a first position wherein the upper portion is in a horizontal orientation and the lower portion is in a vertical orientation to a second position wherein the upper portion is no longer in the horizontal orientation.

11. The toy as in claim 10, wherein a playing piece of the plurality of playing pieces is located at a position elevated from the surface when it is placed upon the upper portion of one of the plurality of planks when the one of the plurality of planks is in the first position.

12. The toy as in claim 11, wherein the one of the plurality of planks moves from the first position to the second position when the object is slid along the surface and contacts the lower portion of the one of the plurality of planks.

13. The toy as in claim 9, wherein at least one of the plurality of planks moves from a first position to a second position when the object is slid along the surface the bottom of the of the first vertical end structure and the bottom of second vertical end structure are resting on, and wherein the object contacts the lower portion of the at least one of the plurality of planks.

14. The toy as in claim 9, wherein the playing pieces are subdivided into a first group of playing pieces and a second group of playing pieces, wherein the first group is different from the second group.

15. The toy as in claim 9, wherein the lower portion of each of the plurality of planks is configured to have similar dimensions.

16. The toy as in claim 11, wherein the playing piece is dislodged from the position when the one of the plurality of planks is moved from the first position to the second position.

* * * * *